US012167822B2

(12) United States Patent
Büsing et al.

(10) Patent No.: US 12,167,822 B2
(45) Date of Patent: Dec. 17, 2024

(54) DISHWASHER INCLUDING A DRYING APPARATUS

(71) Applicant: Samsung Electronics Co., Ltd., Suwon-si (KR)

(72) Inventors: Johannes Büsing, Suwon-si (KR); Jongwook Kwon, Suwon-si (KR); Sojeong Kim, Suwon-si (KR); Changhyun Kim, Suwon-si (KR); Hyunjoo Kim, Suwon-si (KR); Woojin Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/681,566

(22) Filed: Feb. 25, 2022

(65) Prior Publication Data

US 2022/0330787 A1 Oct. 20, 2022

Related U.S. Application Data

(63) Continuation of application No. PCT/KR2022/002172, filed on Feb. 14, 2022.

(30) Foreign Application Priority Data

Apr. 16, 2021 (KR) ..... 10-2021-0049630

(51) Int. Cl.
*A47L 15/42* (2006.01)
*A47L 15/48* (2006.01)

(52) U.S. Cl.
CPC ..... *A47L 15/4287* (2013.01); *A47L 15/486* (2013.01)

(58) Field of Classification Search
CPC ..... A47L 15/486; A47L 15/4827; A47L 2401/18; A47L 2501/11; A47L 2501/10; A47L 2501/12; A47L 15/4287
See application file for complete search history.

(56) References Cited

U.S. PATENT DOCUMENTS

2004/0200508 A1* 10/2004 Jung ..... A47L 15/4257 134/186
2006/0090778 A1* 5/2006 Oakes ..... A47L 15/488 134/56 D (Continued)

FOREIGN PATENT DOCUMENTS

CN 105919534 A 9/2016
CN 209996270 U * 1/2020

(Continued)

OTHER PUBLICATIONS

International Search Report and Written Opinion of the International Searching Authority dated Jun. 16, 2022, in connection with International Application No. PCT/KR2022/002172, 7 pages.

(Continued)

*Primary Examiner* — Jason Y Ko

(57) ABSTRACT

A dishwasher including a tub provided in the cabinet to form a washing chamber, and a drying apparatus arranged on a side wall of the tub and including a flow path provided to allow air sucked from the washing chamber to flow, a heater arranged in the flow path to heat air in the flow path, and a switch arranged upstream of the heater to turn off the heater in response to air, which is adjacent to the heater, reaching a predetermined temperature.

14 Claims, 12 Drawing Sheets

(56) References Cited

U.S. PATENT DOCUMENTS

| | | | | |
|---|---|---|---|---|
| 2010/0101613 | A1* | 4/2010 | Jerg | A47L 15/481 34/498 |
| 2011/0114137 | A1* | 5/2011 | Jerg | A47L 15/4287 134/115 R |
| 2013/0125411 | A1 | 5/2013 | Dreossi et al. | |
| 2014/0223761 | A1* | 8/2014 | Lee | A47L 15/488 34/218 |
| 2016/0334133 | A1* | 11/2016 | Zoppas | F04D 15/0088 |
| 2017/0188777 | A1 | 7/2017 | Kim et al. | |
| 2017/0188779 | A1 | 7/2017 | Lee | |
| 2020/0100644 | A1* | 4/2020 | Kopera | A47L 15/488 |

FOREIGN PATENT DOCUMENTS

| | | | | | |
|---|---|---|---|---|---|
| CN | 111802996 | A | | 10/2020 | |
| CN | 110464280 | B | | 2/2023 | |
| DE | 4030415 | A1 | * | 4/1992 | |
| DE | 10346388 | A1 | * | 5/2004 | A47L 15/483 |
| DE | 102012202738 | A1 | | 8/2013 | |
| EP | 1578244 | B1 | | 11/2009 | |
| EP | 2173229 | B1 | * | 5/2014 | A47L 15/4287 |
| EP | 3653100 | A1 | * | 5/2020 | A47L 15/0026 |
| EP | 3741286 | A1 | * | 11/2020 | |
| FR | 2491322 | A1 | | 4/1982 | |
| JP | 3216887 | B2 | * | 8/1992 | |
| JP | H-0624668 | U | * | 4/1994 | |
| JP | H-0819502 | A | * | 1/1996 | |
| JP | H-10170148 | A | * | 6/1998 | |
| JP | 2005241097 | A | * | 9/2005 | |
| JP | 3728235 | B2 | | 12/2005 | |
| JP | 2008-148795 | A | | 7/2008 | |
| JP | 2011217812 | A1 | * | 11/2011 | |
| JP | 5385204 | B2 | | 1/2014 | |
| JP | 2014226149 | A | * | 12/2014 | |
| JP | 2014226456 | A | | 12/2014 | |
| JP | 5735358 | B2 | | 6/2015 | |
| JP | 6119613 | B2 | | 4/2017 | |
| JP | 2020-058461 | A | | 4/2020 | |
| JP | 2020-078389 | A | | 5/2020 | |
| JP | 6906623 | B2 | | 7/2021 | |
| KR | 20-1998-0058484 | U | | 10/1998 | |
| KR | 10-1435838 | B1 | | 8/2014 | |
| KR | 20150022437 | A | * | 3/2015 | A47L 15/481 |
| KR | 101579461 | B1 | | 12/2015 | |
| KR | 20160025342 | A | * | 3/2016 | A47L 15/42 |
| KR | 10-2017-0011702 | A | | 2/2017 | |
| KR | 10-2017-0081477 | A | | 7/2017 | |
| KR | 20180097292 | A | | 8/2018 | |
| KR | 102448861 | B1 | | 9/2022 | |
| WO | WO-2009056451 | A1 | * | 5/2009 | A47L 15/481 |

OTHER PUBLICATIONS

Supplementary European Search Report dated Jul. 3, 2024, in connection with European Patent Application No. 22788244.6, 8 pages.

* cited by examiner

DISHWASHER INCLUDING A DRYING APPARATUS

CROSS-REFERENCE TO RELATED APPLICATIONS

This application is a continuation of International Patent Application No. PCT/KR2022/002172 filed on Feb. 14, 2022, which is based on and claims priority under 35 U.S.C. § 119 to Korean Patent Application No. 10-2021-0049630 filed on Apr. 16, 2021, in the Korean Intellectual Property Office, the disclosures of which are herein incorporated by reference in their entirety.

BACKGROUND

1. Field

The disclosure relates to a dishwasher, and more particularly, to a dishwasher configured to control a humidity in a washing chamber.

2. Description of Related Art

In general, a dishwasher is a device for washing and drying stored dishes by spraying washing water at a high pressure. The dishwasher is operated in such a way that washing water is sprayed at high pressure into a washing chamber in which dishes are stored, and the sprayed washing water comes into contact with the dishes to wash foreign substances such as food waste on a surface of the dishes.

Particularly, the dishwasher may include a washing cycle, a rinsing cycle, and a drying cycle. During the drying cycle, the water on the dishes evaporates and condensed water may be generated in a tub. If a heater is used during the drying cycle, it is possible to obtain not only a quick drying effect, but also a sterilization effect by using heated air.

In the conventional manner using heated air, the structure for heating the air may be complicated, or contaminants in the washing chamber may be introduced into a drying apparatus. Accordingly, there is a demand for a dishwasher that has a simple internal structure to easily discharge condensed water, which is generated during the drying cycle, and that prevents contaminants from flowing into a drying apparatus.

SUMMARY

Therefore, it is an aspect of the disclosure to provide a dishwasher including a drying apparatus capable of drying a dish in a washing chamber.

It is another aspect of the disclosure to provide a dishwasher including a drying apparatus including a simple air circulation structure.

It is another aspect of the disclosure to provide a dishwasher capable of preventing foreign substances or washing water from entering into a drying apparatus.

Additional aspects of the disclosure will be set forth in part in the description which follows and, in part, will be obvious from the description, or may be learned by practice of the disclosure.

In accordance with an aspect of the disclosure, a dishwasher includes a tub forming a washing chamber, and a drying apparatus disposed on a side wall of the tub, and comprising a flow path configured to guide air sucked from the washing chamber, a heater disposed in the flow path and configured to heat air in the flow path, and a switch positioned upstream of the heater and configured to turn off the heater in response to the air, which is adjacent to the heater, reaching a predetermined temperature.

The drying apparatus further comprises a fan positioned upstream of the heater on the flow path to move the air through the flow path, and the switch is positioned downstream of the fan and upstream of the heater.

The drying apparatus may further include a temperature sensor arranged downstream of the heater in the flow path and configured to detect a temperature of the air passing through the heater.

The fan, switch, the heater and the temperature sensor may be sequentially arranged from an upper side to a lower side.

The drying apparatus may further include a first housing coupled to an outer surface of the tub and extending in a vertical direction; and a second housing extending in the vertical direction and coupled to the first housing to form the flow path. The fan, the switch, the heater, and the temperature sensor are disposed between the first and second housings.

The dishwasher may further include a cabinet configured to accommodate the tub. The second housing may include a plurality of separation ribs protruding from an outer surface of the second housing toward the cabinet to space the outer surface of the second housing from an inner surface of the cabinet.

The drying apparatus may include an inlet configured to allow air in the washing chamber to enter the flow path, and an inlet cover arranged on an inner surface of the tub to cover the inlet so as to prevent foreign substances or washing water in the washing chamber entering the flow path.

The drying apparatus may further include a housing coupled to an outer surface of the tub, and the inlet cover is removably coupled with the housing.

The inlet cover may be rotatably coupled to the housing.

The dishwasher may further include a coupling member configured to couple the housing and the inlet cover.

The coupling member may be formed in an annular shape, and include a coupling rib protruding in a radial direction from an outer circumferential surface of the coupling member. The housing may include a receiving rib protruding toward the inlet cover and configured to receive the coupling rib.

The dishwasher may further include a basket movably disposed in the washing chamber and configured to accommodate a dish. The inlet cover may be disposed adjacent to a rear wall of the tub and configured to prevent interference with the dish accommodated in the basket in response to inserting or withdrawing the basket.

The dishwasher may further include a basket disposed in the washing chamber and configured to accommodate a dish, and an inlet space formed between the inlet cover and the inlet and configured to allow air in the washing chamber to flow to the inlet. The inlet cover may include a base member disposed adjacent to an inner wall of the tub so as not to interfere with the basket, and a protrusion protruding from the base member toward an inside of the washing chamber to form the inlet space.

The inlet cover may include an intake through which air in the washing chamber is introduced. The coupling member may include a prevention portion protruding toward the washing chamber and is configured to prevent foreign substances or washing water in the washing chamber from being introduced thereinto through the intake.

The heater may include a power connection terminal configured to receive power to operate the heater, and a sheath heater connected to a bottom side of the power connection terminal and configured to receive power from the power connection terminal to heat the air in the flow path.

In accordance with another aspect of the disclosure, a dishwasher includes a tub forming a washing chamber, a basket movably arranged in the washing chamber, a drying apparatus arranged on a wall of the tub, and including a flow path including an inlet provided to suck air from the washing chamber, the flow path in which the air sucked from the washing chamber flows, the dry apparatus including a heater arranged in the flow path to heat air in the flow path, and an inlet cover arranged adjacent to a rear wall of the tub and configured to cover the inlet to prevent at least one of foreign substances or washing water in the washing chamber from entering the flow path, and prevent interference with a movement of the basket in the washing chamber.

The drying apparatus may include a housing coupled to an outer surface of the tub, and the inlet cover may be arranged on an inner surface of the tub so as to be detachably coupled to the housing.

The inlet cover may be rotatably coupled to the housing.

In accordance with another aspect of the disclosure, a dishwasher includes a cabinet, a tub provided in the cabinet to form a washing chamber, and a drying apparatus arranged on a side of the tub. The drying apparatus includes a flow path configured to guide air sucked from the washing chamber and including an inlet and an outlet, a fan arranged on the flow path and configured to move the air through the flow path, a heater arranged downstream of the fan in the flow path and configured to dry air in the flow path, and a switch arranged upstream of the heater to turn off the heater in response to the air, which is adjacent to the heater, reaching a predetermined temperature.

The switch may be arranged below the fan and above the heater.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
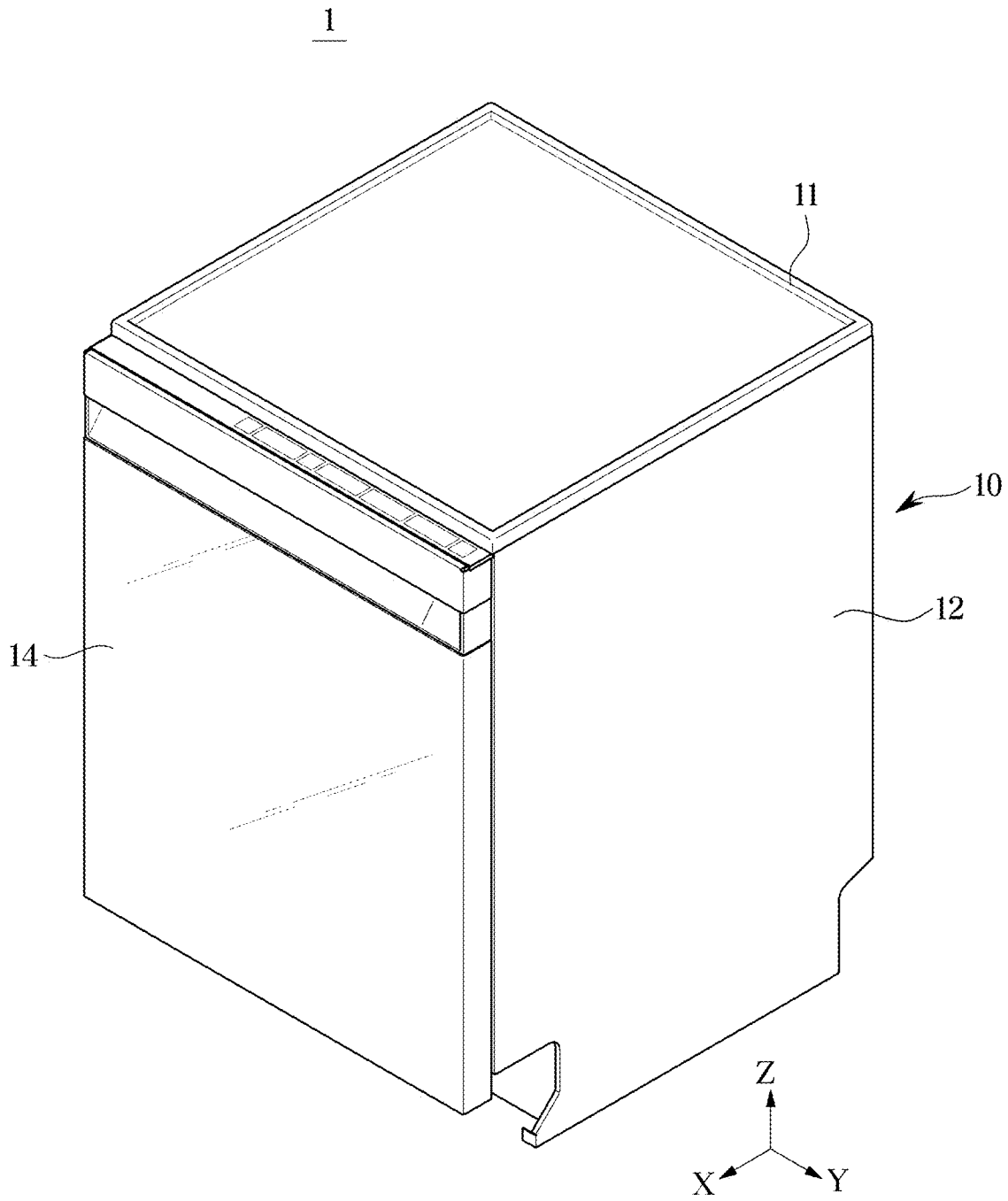
FIG. 1 is a perspective view illustrating a dishwasher according to an embodiment of the disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front side", "rear side", "left side", "right side" and the like may be defined by the drawings, but the shape and the location of the component is not limited by the term.

Hereinafter an embodiment according to the disclosure will be described in detail with reference to the accompanying drawings.

Figure 2:
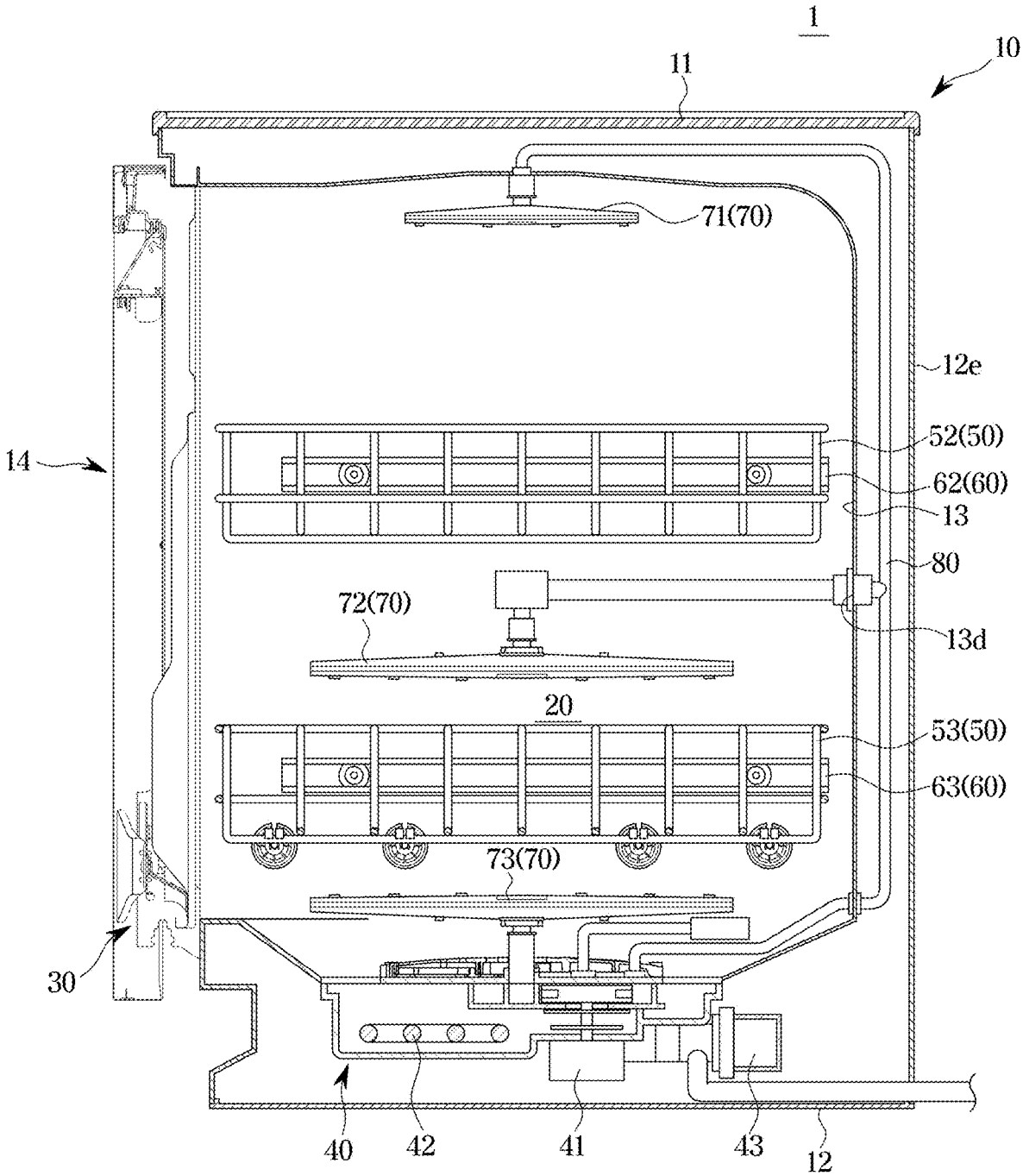
FIG. 2 is a side cross-sectional view illustrating the dishwasher illustrated in FIG. 1.
Figure 3:
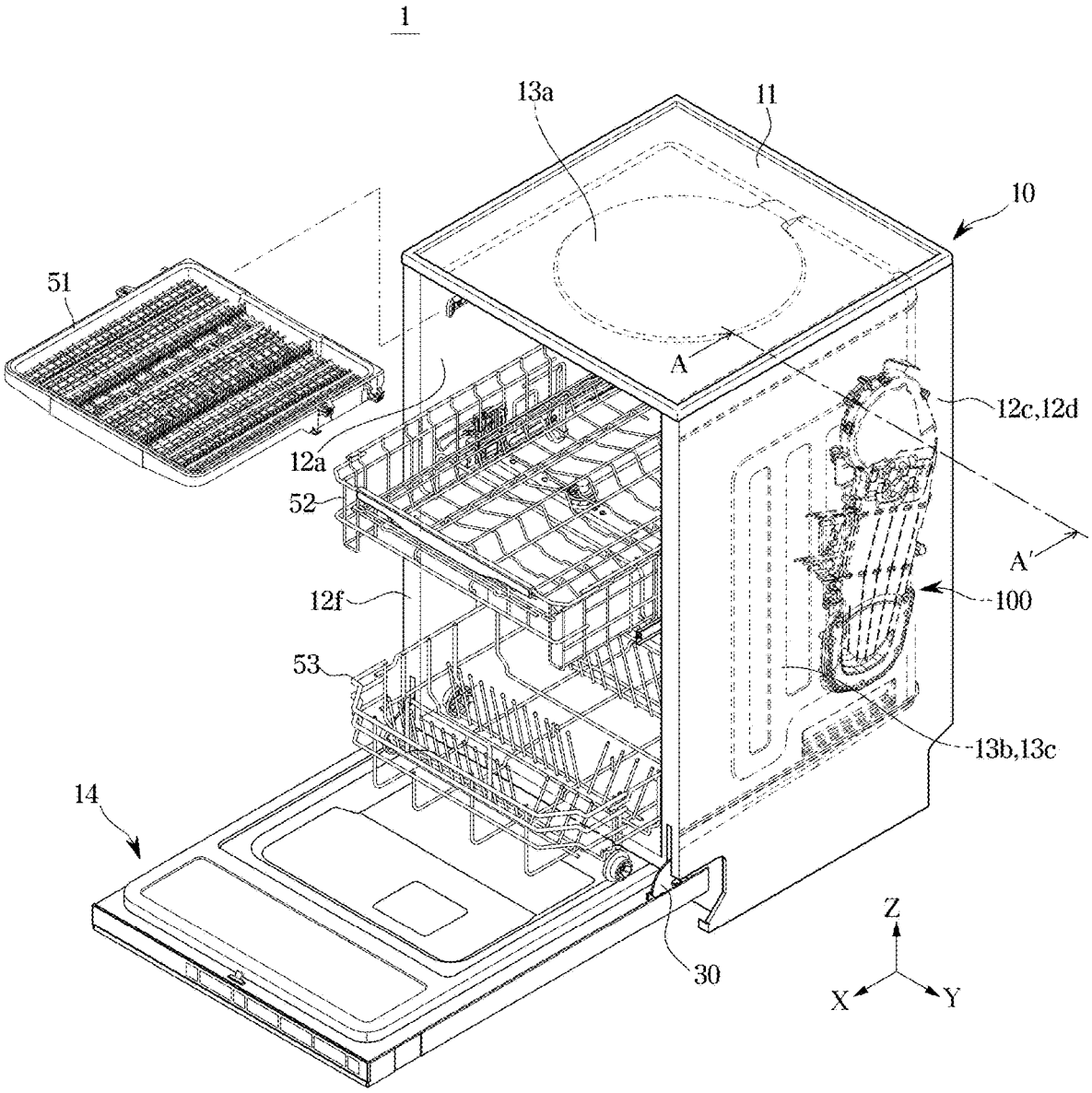
FIG. 3 is a perspective view illustrating a state in which a door is opened in the dishwasher illustrated in FIG. 1.

FIG. 1 is a perspective view illustrating a dishwasher according to an embodiment of the disclosure. FIG. 2 is a side cross-sectional view illustrating the dishwasher illustrated in FIG. 1. FIG. 3 is a perspective view illustrating a state in which a door is opened in the dishwasher illustrated in FIG. 1.

Referring to FIGS. 1 to 3, a dishwasher 1 may include a body 10. The body 10 may include a cabinet 12 forming an exterior, a tub 13 arranged inside the body 10 and forming a washing chamber 20, and a door 14 installed in the cabinet 12 and configured to open and close the tub 13. However, the dishwasher 1 may be provided in a built-in form, and in this case, the cabinet 12 may be omitted.

The cabinet 12 may be provided in a substantially box shape. One side of the cabinet 12 may be opened. That is, the cabinet 12 may include an opening 12*a*. As an example, a front surface of the cabinet 12 may be opened.

The cabinet 12 and the tub 13 are provided in the shape of a hexahedron in which substantially one surface is opened so as to serve as an opening. The body 10 may include a top cover 11 provided on an upper side of the cabinet 12.

The cabinet 12 may include a rear plate 12*e*, both side plates 12*c* and 12*d* extending to one side and the other in front of the rear plate 12*e*, and a front plate 12*f* formed to be bent from the both side plates 12*c* and 12*d*. The front plate 12*f* may be provided to form the opening 12*a* in the front of the cabinet 12. The door 14 may be configured to open and close the opening 12*a* of the front plate 12*f*. It is illustrated that the front plate 12*f* is integrally extended from the both side plates 12*c* and 12*d* according to an embodiment of the disclosure, but is not limited thereto.

The door 14 may be rotatably installed in the cabinet 12. The door 14 may be rotatably hinged to a lower end of the cabinet 12. The door 14 may be coupled to the cabinet 12 by a hinge device 30.

Inside the cabinet 12, a sump unit 40 is arranged below the tub 13 to collect water used for washing, and a plurality of baskets 50 provided to be withdrawable from an inside of the cabinet 12 to an outside thereof and in which a dish is placed, a guide rack 60 provided to support the plurality of baskets 50, and a plurality of spray nozzles 71, 72 and 73 configured to spray water, which is delivered from the sump unit 40, toward the dish contained in the plurality of baskets 50.

Relatively large dishes may be accommodated in the plurality of baskets 50. There is no limitation in the types and sizes of dishes accommodated in the plurality of baskets 50. The types of dishes accommodated in the plurality of baskets 50 may include relatively large or small dishes.

The plurality of baskets 50 may include a first basket 51, a second basket 52, and a third basket 53. The first basket 51 may be coupled to the tub 13 at an upper portion of the tub 13 so as to be located above the second basket 52 and the third basket 53. The first basket 51 may be located above the second basket 52. The second basket 52 may be coupled to the tub 13 at a middle portion of the tub 13 so as to be located below the first basket 51 and/or above the third basket 53. The third basket 53 may be coupled to the tub 13 at a lower portion of the tub 13 to be located below the first and second baskets 51 and 52. The first basket 51 may correspond to a sub-basket in which a dish having a relatively small volume is accommodated. A small cup such as an espresso cup may be accommodated in the sub-basket. However, the types of dishes accommodated in the sub-basket, first basket 51, are not limited to the above example.

The dishwasher 1 may include a first guide rack 61 provided to support the first basket 51, a second guide rack 62 provided to support the second basket 52, and a third guide rack 63 provided to support the third basket 53 in the tub 13. The guide racks 61, 62, and 63 may correspond to rails for withdrawing out the baskets 51, 52 and 53, respectively.

The first guide rack 61, the second guide rack 62 and the third guide rack 63 may be installed on inner walls 13*b* and 13*c* of the tub 13 to allow the first basket 51, the second basket 52 and the third basket 53 to be slide toward the front surface of the tub 13. For example, the guide rack 60 may be installed on a left wall 13*b* and a right wall 13*c* of the tub 13.

The first basket 51, the second basket 52, and the third basket 53 may slide in a front and rear direction of the tub 13 along the first guide rack 61, the second guide rack 62, and the third guide rack 63.

The sump unit 40 may be arranged at a lower center of the cabinet 12 to collect washing water used for washing. The sump unit 40 may be provided with a washing pump 41 configured to pump the stored water to a spray unit 70. The washing water pumped by the washing pump 41 may be supplied to a first spray nozzle 71, a second spray nozzle 72, and a third spray nozzle 73 through a supply pipe 80.

The dishwasher 1 may further include a washing water heater 42 arranged in a lower portion of the cabinet 12 to heat the washing water, and a drain pump 43 arranged below the tub 13 to drain the washing water.

The dishwasher 1 may include the spray unit 70 configured to spray washing water. The spray unit 70 may include the first spray nozzle 71 arranged above the first basket 51, the second spray nozzle 72 disposed below the first basket 51 and the second basket 52, that is, arranged between the second basket 52 and the third basket 53, and the third spray nozzle 73 arranged below the third basket 53.

The first spray nozzle 71 is configured to be rotatable. The first spray nozzle 71 may spray the washing water toward the dishes stored in the first basket 51 and/or the second basket 52. The second spray nozzle 72 is configured to be rotatable. The second spray nozzle 72 is configured to spray the washing water toward the dishes stored in the second basket 52 and the third basket 53. The third spray nozzle 73 is configured to be rotatable. The third spray nozzle 73 is configured to spray the washing water toward the dishes stored in the third basket 53.

The dishwasher may include a drying apparatus 100. The drying apparatus 100 may be coupled to one wall of the tub 13. For example, the drying apparatus 100 may be coupled to one of the sidewalls 13*b* and 13*c* of the tub 13. Therefore, there is little possibility that water falling from the dishes is introduced into an inside of the drying apparatus 100 when the basket 50 is moved. Alternatively, the drying apparatus 100 may be coupled to an upper wall 13*a* or a rear wall 13*d* of the tub 13. The drying apparatus 100 may heat the air in the washing chamber 20 to lower a relative humidity of the air. Details will be described later.

Figure 4:
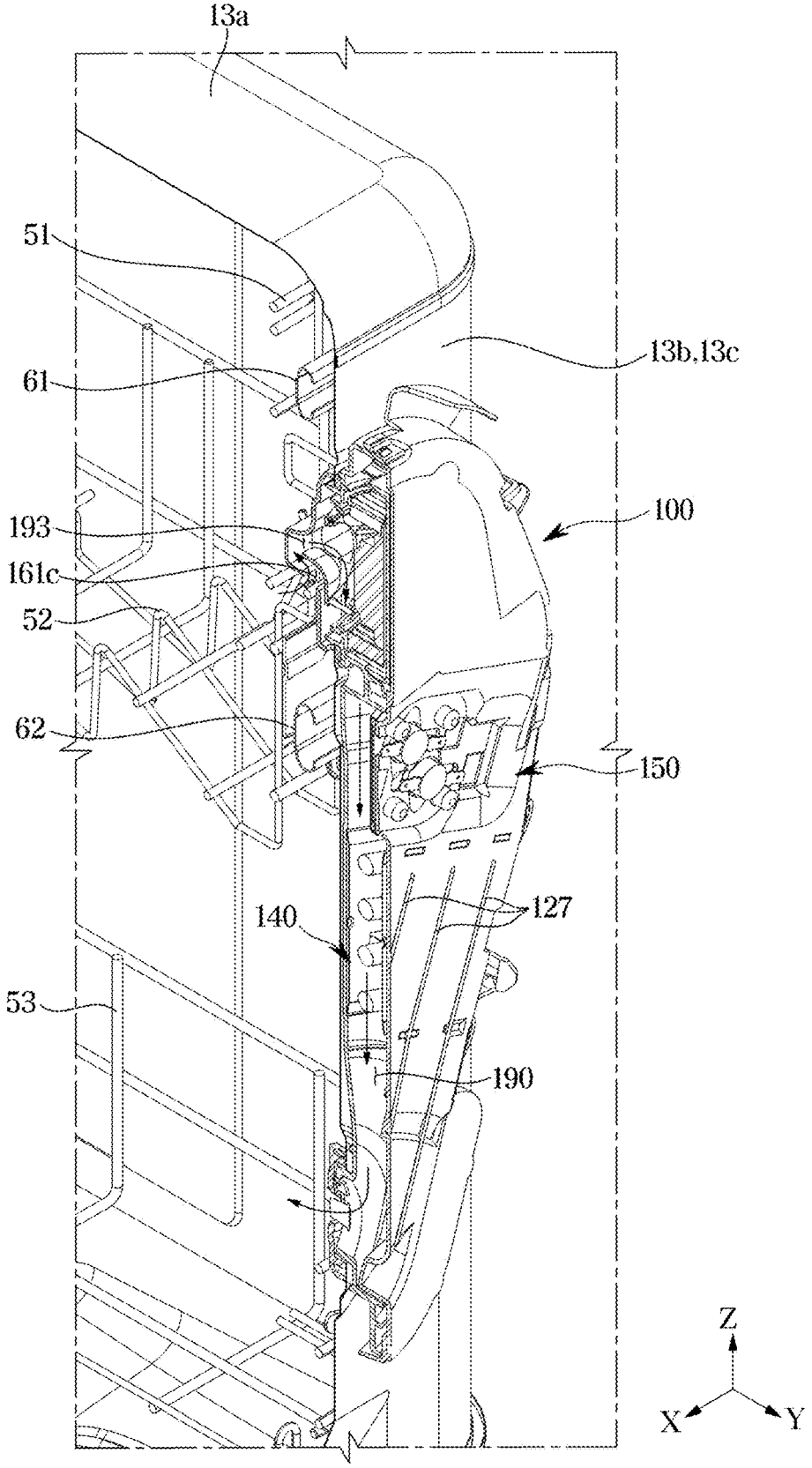
FIG. 4 is a cross-sectional perspective view illustrating the dishwasher illustrated in FIG. 3.
Figure 5:
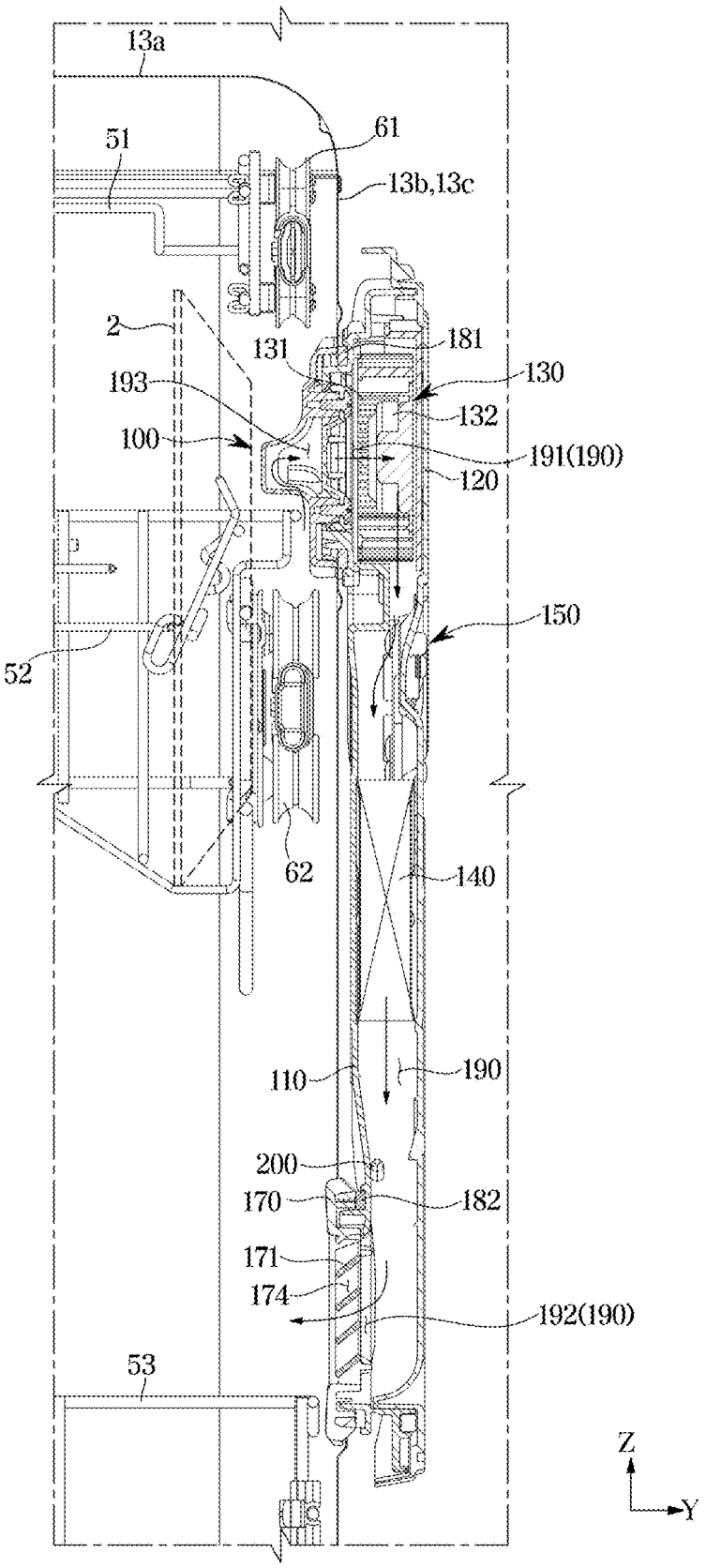
FIG. 5 is a cross-sectional view illustrating the dishwasher illustrated in FIG. 4.

FIG. 4 is a cross-sectional perspective view illustrating the dishwasher illustrated in FIG. 3. FIG. 5 is a cross-sectional view illustrating the dishwasher illustrated in FIG. 4. FIGS. 4 and 5 illustrate a cross-section taken along line A-A' of FIG. 3.

Referring to FIGS. 4 and 5, the dishwasher 1 may include the drying apparatus 100. The drying apparatus 100 may be arranged on the sidewalls 13*b* and 13*c* of the tub 13. For example, the drying apparatus 100 may be arranged between an outer surface of the tub 13 and an inner surface of the cabinet 12. The drying apparatus 100 may be coupled to the sidewalls 13*b* and 13*c* of the tub 13. The drying apparatus 100 and an inlet cover 161 may be arranged adjacent to the rear wall 13*d* of the tub 13. The baskets 51, 52, and 53 may be movable in the front and rear directions by the guide racks 61, 62, and 63. Because the inlet cover 161 is arranged adjacent to the rear wall 13*d*, it is possible to minimize interference with the movement of the baskets 51, 52, and 53 caused by the inlet cover 161. Particularly, a dish 2 may be accommodated in the second basket 52, and the dish 2 may interfere with the inlet cover 161 in response to the second basket 52 being moved forward and backward. In this case, because the inlet cover 161 is adjacent to the rear wall 13*d*, the interference, which is generated by the dish 2 when the second basket 52 is moved, may be minimized. The types of the dish 2 are not limited to those illustrated in the drawings.

In addition, the inlet cover 161 may be arranged below the first guide rack 61 and/or above the second guide rack 62. The inlet cover 161 may be arranged between the first guide rack 61 and the second guide rack 62. For example, the inlet cover 161 may be arranged between the first basket 51 and the second basket 52. The arrangement of the inlet cover 161 may minimize interference with the movement of the first and second baskets 51 and 52.

Further, the dishwasher may include a height adjuster provided adjacent to the sidewalls 13*b* and 13*c* of the tub. The height adjuster may be configured to adjust a height at which the second basket 52 is inserted into the washing chamber 20. For example, the height of the second basket 52 may be increased toward the first basket 51 or may be decreased toward the third basket 53. However, even if the height of the second basket 52 is changed, the interference is not generated between the inlet cover 161 and the second basket 52.

The dishwasher 1 may perform a washing cycle for washing a dish in the washing chamber 20, a rinsing cycle for rinsing foreign substances on the dish, and a drying cycle for drying the air in the washing chamber 20 after the rinsing cycle. The relative humidity of the air in the washing chamber 20 may be reduced through the drying cycle. In the disclosure, it is described as "air", but the disclosure is not limited thereto, and it may be equally applied to other fluids such as water according to an embodiment of the disclosure.

Hereinafter a process, in which air in the washing chamber 20 is sucked into the drying apparatus 100 and discharged from the drying apparatus 100 to the washing chamber 20 again during the drying cycle, will be described.

In response to the start of the drying cycle, a fan 131 in the drying apparatus 100 may be rotated. The fan 131 may suck humid air in the washing chamber 20. The sucked air may flow through a plurality of intakes 161*c* of the inlet cover 161, and an inlet space 193, which is arranged between the inlet cover 161 and an inlet 191, and then flow into the inlet 191. A flow path 190 may include the inlet 191 and an outlet 192. That is, the air passing through the inlet space 193 may be introduced into the flow path 190. The fan 131 may allow the sucked air to flow through the inlet 191, the fan 131, a switch device 150, a heater 140, and a temperature sensor 200, which are arranged in the flow path 190, in order and then flow back to the washing chamber 20. The fan 131 may suck air in the washing chamber 20 into the flow path 190, and forcefully blow the air in the flow path 190 to allow the air to sequentially flow through the switch device 150 and the heater 140. The fan 131 may be arranged upstream of the switch device 150, the heater 140, and the temperature sensor 200. Accordingly, the fan 131 may blow air to the switch device 150 and the heater 140, and may allow the air to flow back to the washing chamber 20 through the outlet 192. For example, the fan 131 may be arranged above the switch device 150, the heater 140, and the temperature sensor 200. However, the position of the fan 131 is not limited thereto.

The switch device 150 may turn off the heater 140 in response to the air in the flow path 190 being overheated due to the heater 140. For example, the air may not be cooled due to a failure of the fan 131 or a motor 132, and the heater 140 may continuously heat the air. In this case, the air in the flow path 190 may be overheated. If the heater 140 is not turned off, housings 110 and 120 formed of plastic may melt due to the overheated air. To prevent this, a switch 151 of the switch device 150 may turn off the heater 140 in response to the air adjacent to the heater 140 reaching a predetermined temperature. However, the operation of the switch device 150 is not limited to the above example. Even if the fan 131 or the motor 132 does not fail, the switch device 150 may turn off the heater 140 in response to the heater 140 being overheated.

The switch device 150 may be arranged upstream of the heater 140. For example, the switch device 150 may be arranged above the heater 140. As the air is heated by the heater 140, the heated air is directed upward. Accordingly, the switch device 150 may be arranged above the heater 140 to detect a temperature of the heater 140, and thus, in response to the air being overheated, the switch device 150 may turn off the heater 140. Accordingly, it is possible to prevent other components of the dishwasher 1 from being damaged. However, the position of the switch device 150 is not limited to the above example.

The heater 140 may heat the air in the flow path 190. A relative humidity of air heated by the heater 140 may be reduced. The heater 140 may be arranged downstream of the switch device 150. For example, the heater 140 may be arranged below the switch device 150.

The temperature sensor 200 may be arranged downstream of the heater 140 to detect the temperature of the air heated by the heater 140. For example, the temperature sensor 200 may be arranged below the heater 140. However, the position of the heater 140 is not limited to the above example. The temperature sensor 200 may detect the temperature of the heated air and send a signal to a controller (not shown). Accordingly, the controller may control the on-off of the heater 140 according to the temperature of the air.

In other words, the air in the washing chamber 20 may be introduced into the flow path 190 through the inlet 191. The air in the flow path 190 may flow through the fan 131, the switch device 150, the heater 140, and the temperature sensor 200 and flow back to the washing chamber 20 through the outlet 192. The outlet 192 may be formed at a lower portion of the housings 110 and 120 to allow condensed water collected in the housings 110 and 120 to flow into the washing chamber 20.

A discharge port 174 may be formed inside an outlet cover 170, and a blade 171 may be provided in the discharge port 174. The blade 171 may be arranged to allow the air in the flow path 190 to flow to the lower portion of the tub 13. However, the arrangement of the blade 171 is not limited thereto.

Figure 6:
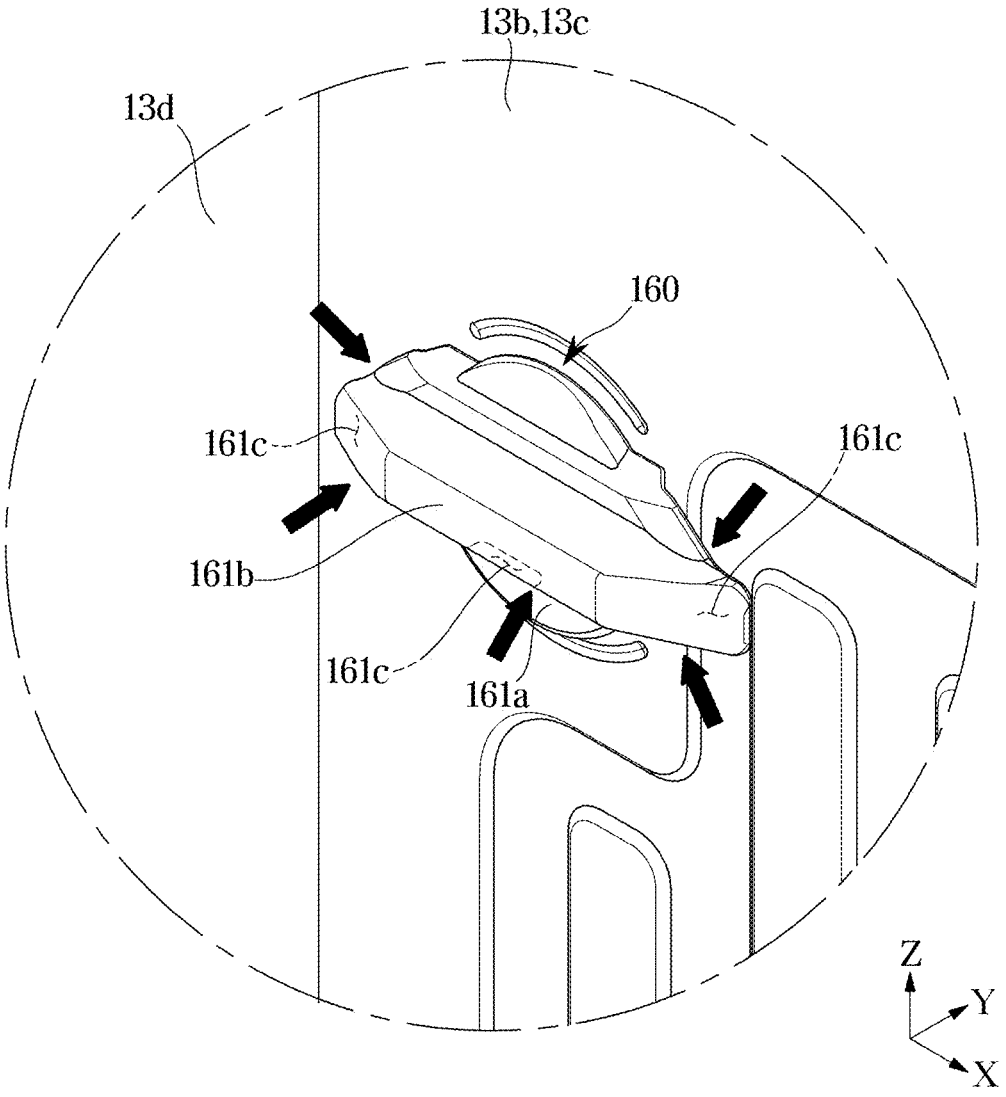
FIG. 6 is a perspective view illustrating an inlet cover assembly mounted on an inner wall of a tub in the dishwasher illustrated in FIG. 1.
Figure 7:
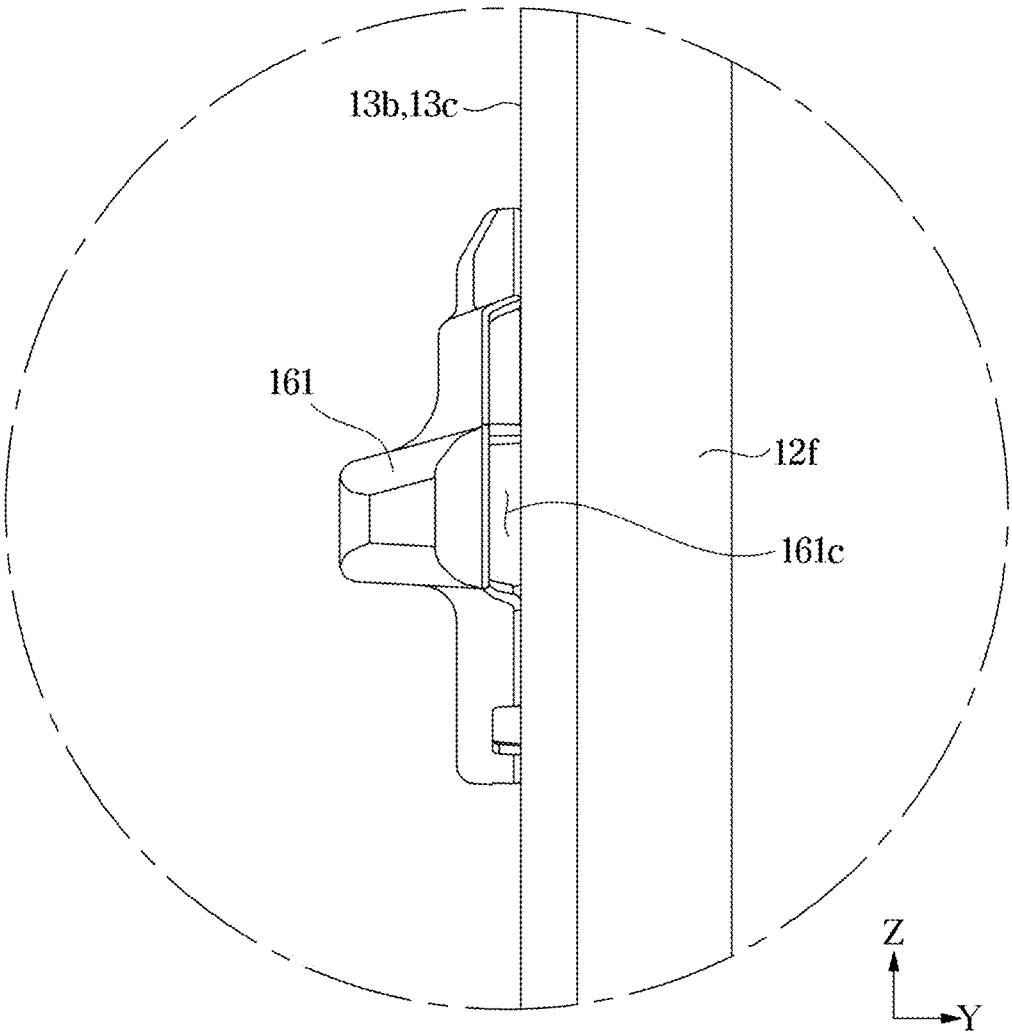
FIG. 7 is a plan view illustrating the inlet cover assembly mounted on the inner wall of the tub in the dishwasher according to FIG. 1.

FIG. 6 is a perspective view illustrating an inlet cover assembly mounted on an inner wall of a tub in the dishwasher illustrated in FIG. 1. FIG. 7 is a plan view illustrating the inlet cover assembly mounted on the inner wall of the tub in the dishwasher according to FIG. 1.

Referring to FIGS. 6 and 7, air may flow into the flow path 190 in the drying apparatus 100 through the intake 161*c* formed in the inlet cover 161. The intake 161*c* may be provided in plurality. The plurality of intakes 161*c* may include a rear intake 161*c* arranged in an −X direction side (e.g., rear side) of the inlet cover 161, a front intake 161*c* arranged in an X direction side (e.g., front side) of the inlet cover 161, and a lower intake 161*c* arranged on a lower surface of a protrusion 161*b*. A portion of the lower intake 161*c* may be formed in a base member 161*a* (refer to FIG. 10). Air in the washing chamber 20 may be introduced into the flow path 190 in a direction of an arrow.

The front side (X direction) intake 161*c* and the rear side (−X direction) intake 161*c* may be arranged between the inner walls 13*b* and 13*c* of the tub 13 and the inlet cover 161. The lower intake 161*c* may be formed to penetrate the inlet cover 161. For example, the lower intake 161*c* may be a through hole (refer to FIG. 10). However, the number, position, and shape of the intake 161*c* is not limited to the above example or the illustrated example.

Figure 8:
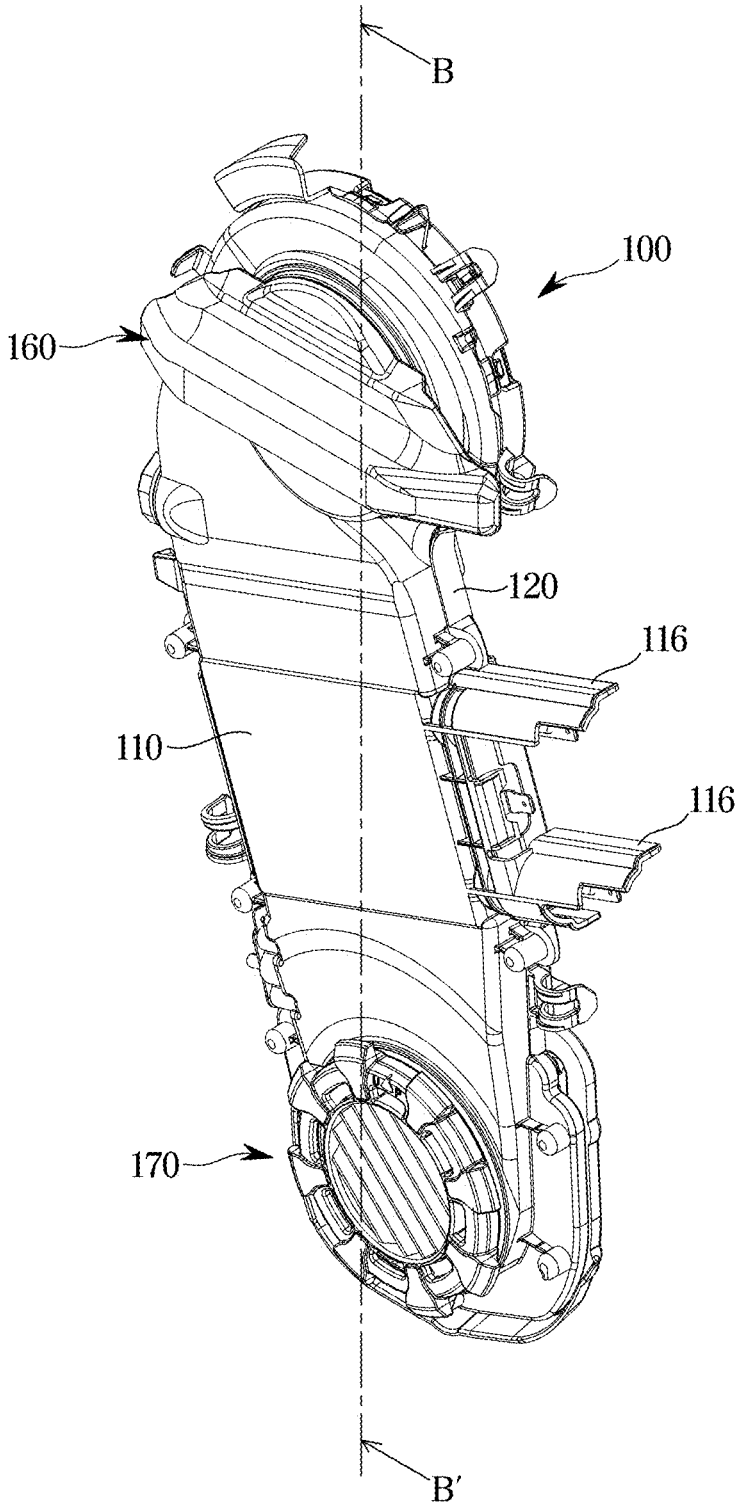
FIG. 8 is a perspective view illustrating a drying apparatus in the dishwasher according to an embodiment of the disclosure.
Figure 9:
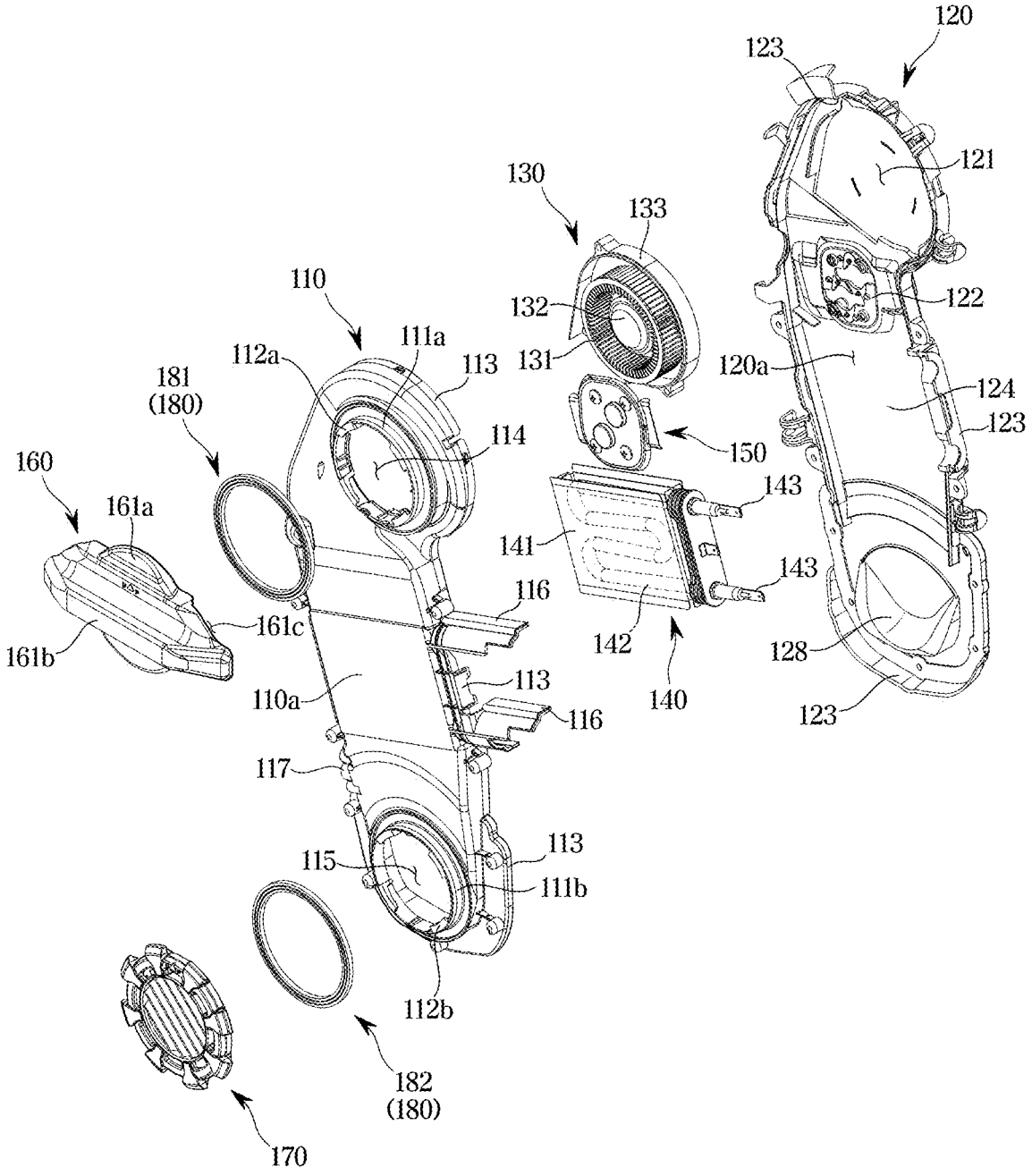
FIG. 9 is an exploded-perspective view illustrating the drying apparatus of the dishwasher illustrated in FIG. 8.

FIG. 8 is a perspective view illustrating a drying apparatus in the dishwasher according to an embodiment of the disclosure. FIG. 9 is an exploded-perspective view illustrating the drying apparatus of the dishwasher illustrated in FIG. 8.

Referring to FIGS. 8 and 9, the dishwasher 1 may include the drying apparatus 100. The drying apparatus 100 may include the housings 110 and 120, a fan assembly 130, the heater 140, the switch device 150, and the flow path 190. However, in the drying apparatus 100, some of the above-described components may be omitted. Further, the dishwasher 1 may include an inlet cover assembly 160 and the outlet cover 170.

The housings 110 and 120 may extend in a Z direction. For example, the housings 110 and 120 may extend in a vertical direction to accommodate the components of the drying apparatus 100, such as the fan 131, the heater 140, and the switch device 150. Accordingly, because the structure of the housings 110 and 120 is simple, even if condensed water is generated, the condensed water may flow downward and be discharged into the washing chamber 20. The housings 110 and 120 may include a first housing 110 and a second housing 120. The first housing 110 and the second housing 120 may be coupled to each other to form the flow path 190 therein.

The first housing 110 may be coupled to the sidewalls 13*b* and 13*c* of the tub 13. The first housing 110 may be coupled to the sidewalls 13*b* and 13*c* of the tub 13 by the inlet cover 161 and the outlet cover 170. For example, the inlet cover 161 and the outlet cover 170 may be rotated to be coupled to the first housing 110.

The first housing 110 may include a base 110*a*, first and second cover coupling portions 111*a* and 111*b*, first and second receiving ribs 112*a* and 112*b*, a housing coupling portion 113, an inlet port 114, an outlet port 115, a terminal protection portion 116 and a temperature sensor receiving portion 117.

The a first cover coupling portion 111*a* may be coupled to the inlet cover assembly 160, and a second cover coupling portion 111*b* to be coupled to the outlet cover 170. The first and second cover coupling portions 111*a* and 112*b* may protrude from the base 110*a* in a direction toward each respective cover. The first and second cover coupling portions 111*a* and 111*b* may be formed in a shape corresponding to the inlet cover assembly 160 or the outlet cover 170. A cover sealing member 180 may be arranged outside each of the first and second cover coupling portions 111*a* and 111*b*. The cover sealing members 180 may be arranged outside the first and second cover coupling portions 111*a* and 111*b*. In response to the drying apparatus 100 being coupled to the tub 13, the cover sealing member 180 may seal between the drying apparatus 100 and the tub 13.

In response to the drying apparatus 100 being coupled to the tub 13, the cover sealing member 180 may seal between the drying apparatus 100 and the tub 13. Particularly, in response to the drying apparatus 100 being coupled to the tub 13, the cover sealing member 180 may seal a coupling space between the tub 13 and the drying apparatus 100. The cover sealing member 180 may seal a space between the tub 13 and the first housing 110. The cover sealing member 180 may be provided in plurality. For example, the plurality of cover sealing members 180 may include a first cover sealing member 181 provided to seal between the tub 13 and the first housing 110 in response to the inlet cover assembly 160 being coupled to the tub 13 and the first housing 110. In addition, the plurality of cover sealing members 180 may include a second cover sealing member 182 provided to seal between the tub 13 and the first housing 110 in response to the outlet cover 170 being coupled to the tub 13 and the first housing 110 (refer to FIG. 12).

The first and second receiving ribs 112*a* and 112*b* may protrude from the first and second cover coupling portions 111*a* and 111*b* toward an inside of the inlet port 114 or the outlet port 115. The first receiving rib 112*a* may protrude from one end of the first cover coupling portion 111*a* toward the inside of the inlet port 114, and a second cover coupling portion 111*b* may protrude from an end of the second cover coupling portion 111*b* toward the inside of the outlet port 115.

Each of the first and second receiving ribs 112*a* and 112*b* may receive a coupling rib 162*c* provided on a coupling member 162 and the coupling rib 173 provided on the outlet cover 170. Accordingly, the inlet cover assembly 160 and the outlet cover 170 may be coupled to the first housing 110, and the drying apparatus 100 may be coupled to the sidewalls 13*b* and 13*c* of the tub 13 (refer to FIG. 12).

The housing coupling portion 113 of the first housing 110 may be coupled to a housing coupling portion 123 of the second housing 120 to allow the first housing 110 and the second housing 120 to be coupled to each other. The shape of the first housing coupling portion 113 is not limited to that illustrated in the drawings. In addition, the first housing coupling portion 113 may be arranged in various positions such as an upper portion, a middle portion, a lower portion, etc. of the first housing 110.

The inlet port 114 may be formed to correspond to the inlet 191 of the flow path 190, and the outlet port 115 may be formed to correspond to the outlet 192 of the flow path 190.

The terminal protection portion 116 may extend in the X direction from the base 110*a*. For example, the terminal protection portion 116 may extend toward a front upper side (refer to FIG. 3). The terminal protection portion 116 may protect a power connection terminal 143 of the heater 140. The power connection terminal 143 may be arranged on a front upper side to prevent the condensed water in the drying apparatus 100 from flowing to the power connection terminal 143.

The temperature sensor receiving portion 117 may be formed on one side of the first housing 110. The temperature sensor receiving portion 117 may receive the temperature sensor 200 in the first housing 110 to allow the temperature sensor 200 to detect a temperature of the air in the flow path 190.

The second housing 120 may be coupled to the first housing 110. The second housing 120 may include a base 120*a*, a fan receiving portion 121, a switch device coupling portion 122, a housing coupling portion 123, a heater receiving portion 124, a separation rib 127, a guide portion 128.

The fan receiving portion 121 may receive the fan assembly 130. For example, a seating portion 133 of the fan assembly 130 may be received in the fan receiving portion 121. The fan receiving portion 121 may be coupled to the fan receiving portion 121 through a separate fastening member (not shown).

The switch device coupling portion 122 may be coupled to the switch device 150. Details will be described later. The heater 140 may be mounted on the heater receiving portion 124.

The separation rib 127 may be formed outside the second housing 120. The separation rib 127 may protrude from an outer surface of the second housing 120 toward the cabinet 12 (refer to FIG. 4). The separation rib 127 may allow the outer surface of the second housing 120 and an inner surface of the cabinet to be spaced apart from each other. For example, the separation rib 127 may allow the second housing 120 and the side plate of the cabinet to be spaced apart from each other. Accordingly, a space between the drying apparatus 100 and the cabinet 12 may be formed, and thus it is possible to reduce the transfer of heat that is generated by the heater 140 and transferred to the cabinet 12. In addition, it is possible to allow air to be circulated in the space between the cabinet 12 and the drying apparatus 100. The separation rib 127 may be provided in plurality. In the drawing, the number of separation ribs 127 is shown as four, but the number of separation ribs 127 is not limited thereto.

The guide portion 128 may guide the flow of air to allow the air in the flow path 190 to flow into the washing chamber 20. The guide portion 128 may protrude toward the first housing 110.

The second housing coupling portion 123 may be coupled to the housing coupling portion 113 of the first housing 110 to allow the first housing 110 and the second housing 120 to be coupled to each other. The shape of the second housing coupling portion 123 is not limited to that illustrated in the drawings. In addition, the second housing coupling portion 123 may be arranged in various positions such as an upper portion, a middle portion, and a lower portion of the second housing 120.

The fan assembly 130 may include the fan 131, the motor 132, and the seating portion 133. The fan 131 may allow air in the washing chamber 20 to flow into the flow path 190. The fan 131 may be arranged upstream of the switch device 150 and the heater 140 in the flow path 190. For example, the fan 131 may be arranged in the upper portion of the flow path 190 (refer to FIGS. 4 and 5). The fan 131 may be a centrifugal fan. However, the position and type of the fan 131 is not limited to the above example. The motor 132 may be connected to the fan 131, thereby driving the fan 131. The fan seating portion 133 may cover the fan 131 and the motor 132 and allow the fan 131 and the motor 132 to be mounted therein. The fan seating portion 133 may be coupled to the fan receiving portion 121 of the second housing 120.

The heater 140 may include a heater case 141, a sheath heater 142, and the power connection terminal 143. The heater case 141 may be integrally formed to receive the sheath heater 142 therein. The heater case 141 may form an exterior of the heater 140 to protect the sheath heater 142 arranged therein. The sheath heater 142 may be a tubular heater. Because the sheath heater 142 is used, even when condensed water is generated in the housings 110 and 120, a difficulty may not occur in terms of the function of the heater. For example, even when condensed water is generated in the housings 110 and 120 due to the washing or rinsing cycle before the drying cycle, the heater 140 may secure the function thereof. The power connection terminal 143 may receive power from the dishwasher 1. The power connection terminal 143 may be connected to both ends of the sheath heater 142 to operate the sheath heater 142. The power connection terminal 143 may be arranged on the front upper side. Accordingly, condensed water may not flow toward the terminal 143 (refer to FIG. 3).

The switch device 150 may be configured to turn off the heater 140 in response to the air in the flow path 190 being overheated due to the heater 140. For example, the air may not be cooled due to a failure of the fan 131 or the motor 132, and the heater 140 may continuously heat the air. In this case, the air in the flow path 190 may be overheated. If the heater 140 is not turned off, the housings 110 and 120 formed of plastic may melt due to the overheated air. To prevent this, the switch 151 of the switch device 150 may turn off the heater 140 in response to the air adjacent to the heater 140 reaching the predetermined temperature. However, the operation example of the switch device 150 is not limited to the above example. The switch device 150 may be arranged upstream of the heater 140 (refer to FIG. 5). For example, the switch device 150 may be arranged above the heater 140. As the air is heated by the heater 140, the heated air is directed upward. Accordingly, the switch device 150 may be arranged above the heater 140 to detect the temperature of the heater 140, thereby turning off the heater 140 in response to the air being overheated. However, the position of the switch device 150 is not limited to the above example.

The inlet cover 161 may cover the inlet 191 of the flow path 190 and the inlet port 114 of the first housing 110. By the inlet cover 161, it is possible to prevent foreign substances or washing water from being introduced into the drying apparatus 100 through the inlet 191 during the washing cycle or the rinsing cycle. The inlet cover 161 may include the base member 161*a* and the protrusion 161*b*. The base member 161*a* may cover the inlet 191 to prevent foreign substances from being introduced into the inlet 191. The base member 161*a* may correspond to a cover portion. The protrusion 161*b* may protrude from the base member 161*a* into the washing chamber 20 to form the inlet space 193. Air in the washing chamber 20 may be introduced into the flow path 190 through the inlet space 193.

Figure 10:
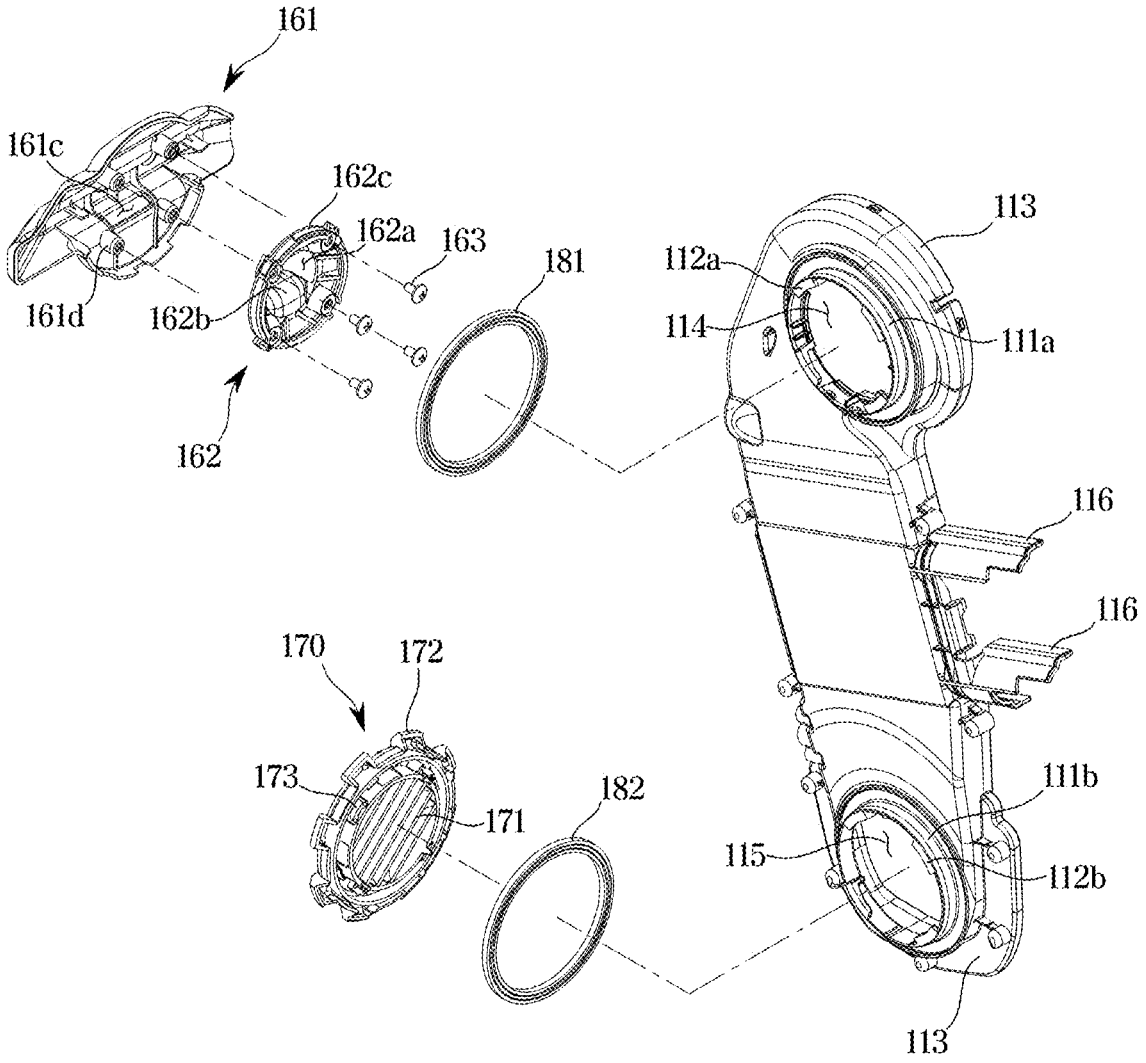
FIG. 10 is an exploded-perspective view illustrating a coupling relationship between the inlet cover and a first housing and a coupling relationship between an outlet cover and the first housing in the drying apparatus of the dishwasher illustrated in FIG. 8.
Figure 11:
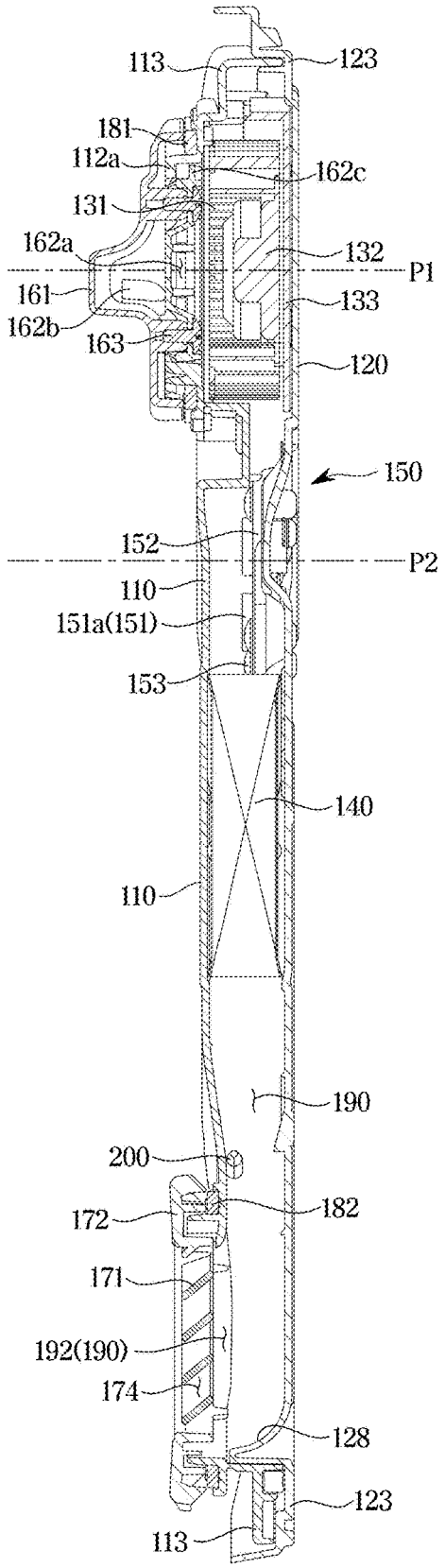
FIG. 11 is a cross-sectional view illustrating the drying apparatus illustrated in FIG. 8.

FIG. 10 is an exploded-perspective view illustrating a coupling relationship between the inlet cover and a first housing and a coupling relationship between an outlet cover and the first housing in the drying apparatus of the dishwasher illustrated in FIG. 8. FIG. 11 is a cross-sectional view illustrating the drying apparatus illustrated in FIG. 8. FIG. 11 is a cross-sectional view illustrating the drying apparatus taken along line B-B' in FIG. 8.

Referring to FIGS. 10 and 11, the inlet cover assembly 160 may be coupled to the first housing 110 with the sidewalls 13*b* and 13*c* of the tub 13 interposed therebetween (refer to FIGS. 4 and 5). Accordingly, the drying apparatus 100 may be coupled to the sidewalls 13*b* and 13*c* of the tub 13.

The inlet cover assembly 160 may be detachably coupled to the first housing 110. The inlet cover assembly 160 may be rotated to be coupled to the first housing 110. For example, the inlet cover assembly 160 may be rotated counterclockwise to be coupled to the first housing 110. Accordingly, a user can easily detach the inlet cover assembly 160 from the first housing 110 or attach the inlet cover assembly 160 to the first housing 110.

The coupling rib 162*c* protruding outward from the coupling member 162 may be coupled to the first receiving rib 112*a* of the first housing 110. In response to the inlet cover assembly 160 being coupled to the first housing 110, the coupling rib 162*c* and the first receiving rib 112*a* may interfere with each other, and thus the inlet cover assembly 160 may not be separated from the first housing 110.

The inlet cover assembly 160 may include the inlet cover 161, the coupling member 162, and a fastening member 163. The inlet cover 161 may be coupled to the coupling member 162 through the fastening member 163. The inlet cover 161 may include a fastening portion 161*d* receiving the fastening member 163. The fastening portion 161*d* may protrude toward the coupling member 162. The fastening portion 161*d* and the fastening member 163 may be provided in plurality. However, in the inlet cover assembly 160, some of the above-described components may be omitted. The coupling member 162 may be integrally formed with the inlet cover 161.

The coupling member 162 may couple the first housing 110 to the inlet cover 161. The coupling member 162 may be formed in an annular shape. The coupling member 162 may include a suction port 162*a*, a prevention portion 162*b*, and the coupling rib 162*c*. The suction port 162*a* may be provided to allow the air, which is introduced from the washing chamber 20 through the intake 161*c*, to flow into the flow path 190. For example, the air in the washing chamber 20 may flow to the inlet 191 by sequentially passing through the plurality of intakes 161*c*, the suction port 162*a*, and the inlet port 114. The prevention portion 162*b* may protrude toward the inlet cover 161 to prevent foreign substances or washing water other than air from being introduced from the intake 161*c* provided in a lower portion of the inlet cover 161. The coupling rib 162*c* may allow the inlet cover assembly 160 to be coupled to the first housing 110. The coupling rib 162*c* may be provided on the outside of the coupling member 162 and received by the first receiving rib 112*a*. For example, in response to the inlet cover assembly 160 being coupled to the first housing 110, the first receiving rib 112*a* and the coupling rib 162*c* may be sequentially arranged in the Y direction.

The outlet cover 170 may be coupled to the first housing 110 with the sidewalls 13*b* and 13*c* of the tub 13 interposed therebetween. For example, the outlet cover 170 may be rotated counterclockwise to be coupled to the first housing 110. Accordingly, the drying apparatus 100 may be coupled to the sidewalls 13*b* and 13*c* of the tub 13 in such a way that the inlet cover assembly 160 and the outlet cover 170 are coupled to the first housing 110, and the tub 13 is arranged therebetween.

The outlet cover 170 may be rotated to be coupled to the first housing 110. For example, the coupling rib 173 may be coupled to the second receiving rib 112*b* of the first housing 110.

The outlet cover 170 may include the blade 171, an outer peripheral protrusion 172, and the coupling rib 173. The coupling rib 173 may be formed on the outside of the discharge port 174. A plurality of coupling ribs 173 may be provided along a circumferential direction of the outlet cover 170. The plurality of coupling ribs 173 may be provided to be spaced apart from each other. The coupling rib 173 of the outlet cover 170 may be coupled to the second receiving rib 112*b* provided in the first housing 110. In response to the outlet cover 170 being coupled to the first housing 110, the coupling rib 173 of the outlet cover 170 and the second receiving rib 112*b* may interfere with each other, and thus the outlet cover 170 may not be separated from the first housing 110. The coupling rib 173 may be formed on the outside so as to be received by the second receiving rib 112*b*. For example, the second receiving rib 112*b* and the coupling rib 173 may be sequentially arranged in the Y direction (refer to FIG. 12).

The drying apparatus 100 may include the switch device 150. The switch device 150 may include the switch 151 including a sensing portion 151*a*, a holder 152 provided to fix the switch 151 to the second housing 120, and a fastening member 153 provided to couple the holder 152 to the second housing 120. The switch 151 may be arranged upstream of the heater 140 and thus the switch 151 may turn off the heater 140 in response to the air in the flow path 190 being heated by the heater 140. For example, the switch 151 may be arranged above the heater 140, and in response to the heated air moving upward, the switch 151 may detect whether the air reaches the predetermined temperature. In response to the air reaching the predetermined temperature, the switch 151 may turn off the heater 140 so as to prevent overheating of the air.

The inlet 191 may be formed on the same axis as a rotation axis P1 of the fan 131. Accordingly, the fan 131 may smoothly suck the air from the inlet.

Further, the rotation axis P1 of the fan 131 may be parallel to an axial direction P2 of the switch 151.

Figure 12:
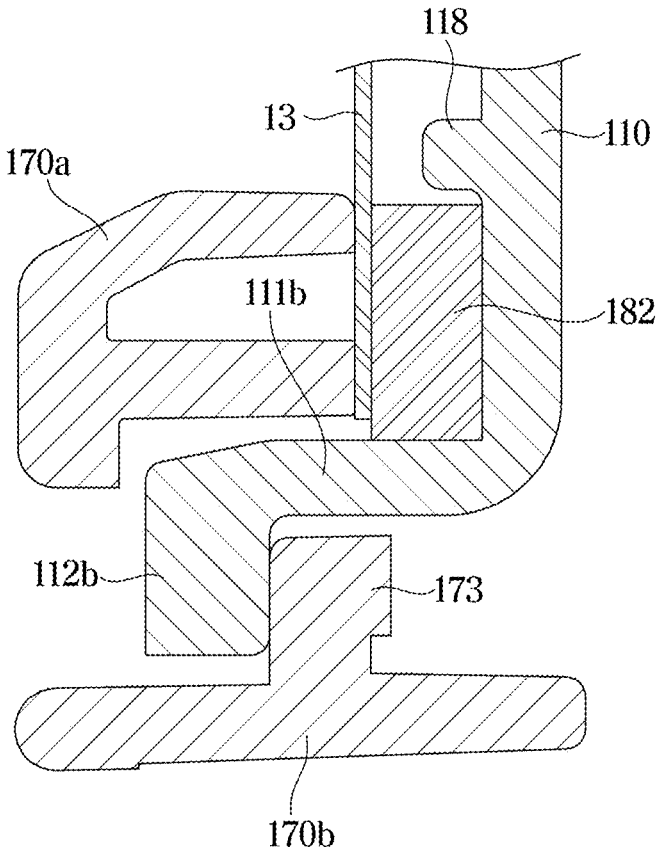
FIG. 12 is a schematic diagram illustrating a coupling relationship among the tub, the drying apparatus, and the outlet cover in the dishwasher illustrated FIG. 1.

FIG. 12 is a schematic diagram illustrating a coupling relationship among the tub, the drying apparatus, and the outlet cover in the dishwasher illustrated FIG. 1.

Referring to FIG. 12, the cover sealing member 180 may seal between the drying apparatus 100 and the tub 13 in response to the drying apparatus 100 being coupled to the tub 13. Particularly, in response to the drying apparatus 100 being coupled to the tub 13, the cover sealing member 180 may seal the space between the tub 13 and the drying apparatus 100. The cover sealing member 180 may seal a space between the tub 13 and the first housing 110. The cover sealing member 180 may be provided in plurality. For example, the plurality of cover sealing members 180 may include the first cover sealing member 181 provided to seal between the tub 13 and the first housing 110 in response to the inlet cover assembly 160 being coupled to the tub 13 and the first housing 110. In addition, the plurality of cover sealing members 180 may include the second cover sealing member 182 provided to seal between the tub 13 and the first housing 110 in response to the outlet cover 170 being coupled to the tub 13 and the first housing 110.

The drying apparatus 100 may include a receiving protrusion 118 protruding from the first housing 110 toward the outlet cover 170 to receive the cover sealing member 180. The receiving protrusion 118 may prevent the cover sealing member 180 from being separated in a state in which the cover sealing member 180 is arranged between the tub 13 and the first housing 110.

FIG. 12 illustrates a case in which the outlet cover 170, the tub 13 and the first housing 110 are coupled to each other.

In response to the outlet cover 170 being coupled to the first housing 110, the drying apparatus 100 may be coupled to the tub 13. The second receiving rib 112*b* and the coupling rib 173 provided on the outlet cover 170 may be coupled to each other. The outlet cover 170 may pull the drying apparatus 100 toward an inner direction of the tub 13. For example, the coupling rib 173 of the outlet cover 170 may pull the second receiving rib 112*b* formed in the first housing 110 toward the inside of the tub 13, that is, to an inner direction of the washing chamber 20. Accordingly, the second cover sealing member 182 arranged between the tub 13 and the first housing 110 may be compressed, and the space between the tub 13 and the first housing 110 may be sealed.

The outlet cover 170 may include an outer circumference 170*a* and an inner circumference 170*b*. In response to the second receiving rib 112*b* being pulled to the inside of the tub 13 by the coupling rib 173, the second receiving rib 112*b* may be located between the outer circumference 170*a* and the inner circumference 170*b* with respect to the vertical direction.

Although it has been described in the drawings that the outlet cover 170 and the first housing 110 are coupled, the inlet cover assembly 160 and the first housing 110 may also be coupled in the same manner as above. For example, the first receiving rib 112*a* and the coupling rib 162*c* provided in the coupling member 162 may be coupled to each other. The coupling member 162 may pull the drying apparatus 100 toward the inner direction of the tub 13. For example, the coupling rib 162*c* of the coupling member 162 may pull the first receiving rib 112*a* formed in the first housing 110 toward the inside of the tub 13, that is, to the inner direction of the washing chamber 20. Accordingly, the first cover sealing member 181 arranged between the tub 13 and the first housing 110 may be compressed, and the space between the tub 13 and the first housing 110 may be sealed.

In addition, the drying apparatus 100 may be coupled to the inner wall of the tub 13 by the coupling of the first receiving rib 112*a* and the coupling rib 162*c* provided on the coupling member 162, and by the coupling of the second receiving rib 112*b* and the coupling rib 173 provided at the outlet cover 170.

As is apparent from the above description, a dishwasher may include a drying apparatus configured to dry a dish in a washing chamber.

Further, a dishwasher may include a drying apparatus including a simple air circulation structure.

Further, a dishwasher may prevent foreign substances or washing water from entering into a drying apparatus.

Although the present disclosure has been described with various embodiments, various changes and modifications may be suggested to one skilled in the art. It is intended that the present disclosure encompass such changes and modifications as fall within the scope of the appended claims.

What is claimed is:

1. A dishwasher comprising:

a cabinet;

a tub disposed in the cabinet and forming a washing chamber; and a drying apparatus configured to lower a humidity in the washing chamber, and the drying apparatus comprising:

a housing disposed outside of the tub and configured to form a flow path through which air flows in the housing;

a fan configured to draw air into the housing and to supply the air drawn into the housing to the washing chamber;

a heater disposed in the housing and configured to heat air in the housing;

a temperature sensor positioned downstream of the heater, and configured to detect a temperature of air flowing into the washing chamber; and a switch device provided to be coupled to the housing and arranged above the heater, and the switch device including:

a switch arranged above the heater, adjacent to the heater and configured to detect a temperature of air heated by the heater and to turn off the heater in response to the temperature of the air heated by the heater reaching a predetermined temperature, a holder provided to hold the switch and to be coupled to the housing, and a fastening member provided to be coupled to the holder and the housing so that the holder and the switch are arranged above the heater.

2. The dishwasher of claim 1, wherein:

the fan is positioned upstream of the heater in the housing to move the air into the housing, and the switch device is positioned downstream of the fan.

3. The dishwasher of claim 2, wherein the fan, the switch device, the heater, and the temperature sensor are arranged from a side of the drying apparatus to another side of the drying apparatus.

4. The dishwasher of claim 2, wherein:

the housing comprises:

a first housing coupled to an outer surface of the tub and extending along a direction of air flow; and a second housing extending along the direction of air flow and coupled to the first housing so as to form the flow path with the first housing, and the fan, the heater, and the temperature sensor are disposed between the first and second housings.

5. The dishwasher of claim 4, wherein the second housing comprises a plurality of separation ribs protruding from an outer surface of the second housing toward the cabinet to space the outer surface of the second housing from an inner surface of the cabinet.

6. The dishwasher of claim 1, wherein the drying apparatus comprises:

an inlet configured to allow air in the washing chamber to enter into the flow path; and an inlet cover disposed on an inner surface of the tub to cover the inlet so as to prevent foreign substances or washing water in the washing chamber from entering the housing.

7. The dishwasher of claim 6, wherein:

the inlet cover is removably coupled with the housing.

8. The dishwasher of claim 7, wherein the inlet cover is rotatably coupled to the housing.

9. The dishwasher of claim 8, further comprising:

a coupling member configured to couple the inlet cover to the housing.

10. The dishwasher of claim 9, wherein:

the coupling member is formed in an annular shape, and comprises a coupling rib protruding in a radial direction from an outer circumferential surface of the coupling member, and the housing comprises a receiving rib protruding toward the inlet cover and configured to receive the coupling rib.

11. The dishwasher of claim 6, further comprises:

a basket movably disposed in the washing chamber and configured to accommodate a dish, wherein the inlet cover is disposed adjacent to a rear wall of the tub and configured to prevent interference with the dish accommodated in the basket in response to inserting or withdrawing the basket.

12. The dishwasher of claim 6, further comprising:

a basket disposed in the washing chamber and configured to accommodate a dish; and an inlet space formed between the inlet cover and the inlet and configured to allow air in the washing chamber to flow to the inlet, wherein the inlet cover comprises:

a base member disposed adjacent to an inner wall of the tub so as not to interfere with the basket; and a protrusion protruding from the base member toward an inside of the washing chamber to form the inlet space.

13. The dishwasher of claim 9, wherein:

the inlet cover comprises an intake through which air in the washing chamber is introduced, and the coupling member comprises a prevention portion protruding toward the washing chamber and configured to prevent foreign substances or washing water in the washing chamber from entering the washing chamber through the intake.

14. The dishwasher of claim 1, wherein the heater comprises:

a power connection terminal configured to receive power to operate the heater; and a sheath heater connected to the power connection terminal and configured to receive power from the power connection terminal to heat the air in the housing, wherein the power connection terminal is connected to the sheath heater at an upper portion of the sheath heater.

* * * * *